US007546748B2

(12) United States Patent
Judas

(10) Patent No.: US 7,546,748 B2
(45) Date of Patent: Jun. 16, 2009

(54) PROCESS AND APPARATUS FOR THE SEPARATION OF AIR BY CRYOGENIC DISTILLATION

(75) Inventor: Frederic Judas, Houston, TX (US)

(73) Assignee: Air Liquide Process & Construction, Inc., Houston, TX (US)

( * ) Notice: Subject to any disclaimer, the term of this patent is extended or adjusted under 35 U.S.C. 154(b) by 454 days.

(21) Appl. No.: 11/347,160

(22) Filed: Mar. 30, 2006

(65) Prior Publication Data

US 2006/0169000 A1 Aug. 3, 2006

(51) Int. Cl.
*F25J 3/00* (2006.01)

(52) U.S. Cl. ..... 62/643; 62/648; 62/903

(58) Field of Classification Search ..... 62/903, 62/643, 648

See application file for complete search history.

(56) References Cited

U.S. PATENT DOCUMENTS 3,339,370 A * 9/1967 Streich et al. ..... 62/648
3,469,271 A * 9/1969 Kitamura et al. ..... 62/646
3,798,917 A * 3/1974 Juncker ..... 62/646
4,617,040 A * 10/1986 Yoshino ..... 62/656
5,228,296 A * 7/1993 Howard ..... 62/646
5,666,824 A * 9/1997 Bonaquist ..... 62/646
5,921,108 A * 7/1999 Bonaquist ..... 62/643

* cited by examiner

*Primary Examiner*—William C Doerrler
(74) *Attorney, Agent, or Firm*—Elwood Haynes

(57) ABSTRACT

This disclosure discusses the problems associated with the design, layout, and construction of units and equipment in air separation units. The invention of this disclosure provides a process and apparatus using multiple discrete subcoolers. The nitrogen stream exiting the cryogenic distillation columns cools streams in the subcoolers. By having at least two subcoolers, the size of the nitrogen vent (nitrogen waste or product stream) can be reduced. This saves fabrication costs and improves reliability by reducing thermal stresses in the piping and equipment. Subcoolers cool rich liquid, lean liquid, liquid oxygen, and/or liquid air streams coming from the main heat exchanger or a system of separation columns. The disclosure also discusses integration of the subcoolers with the main heat exchangers.

5 Claims, 3 Drawing Sheets

Battery arrangement for BAHX of an ASU

Battery arrangement for BAHX of an ASU – Figure 1
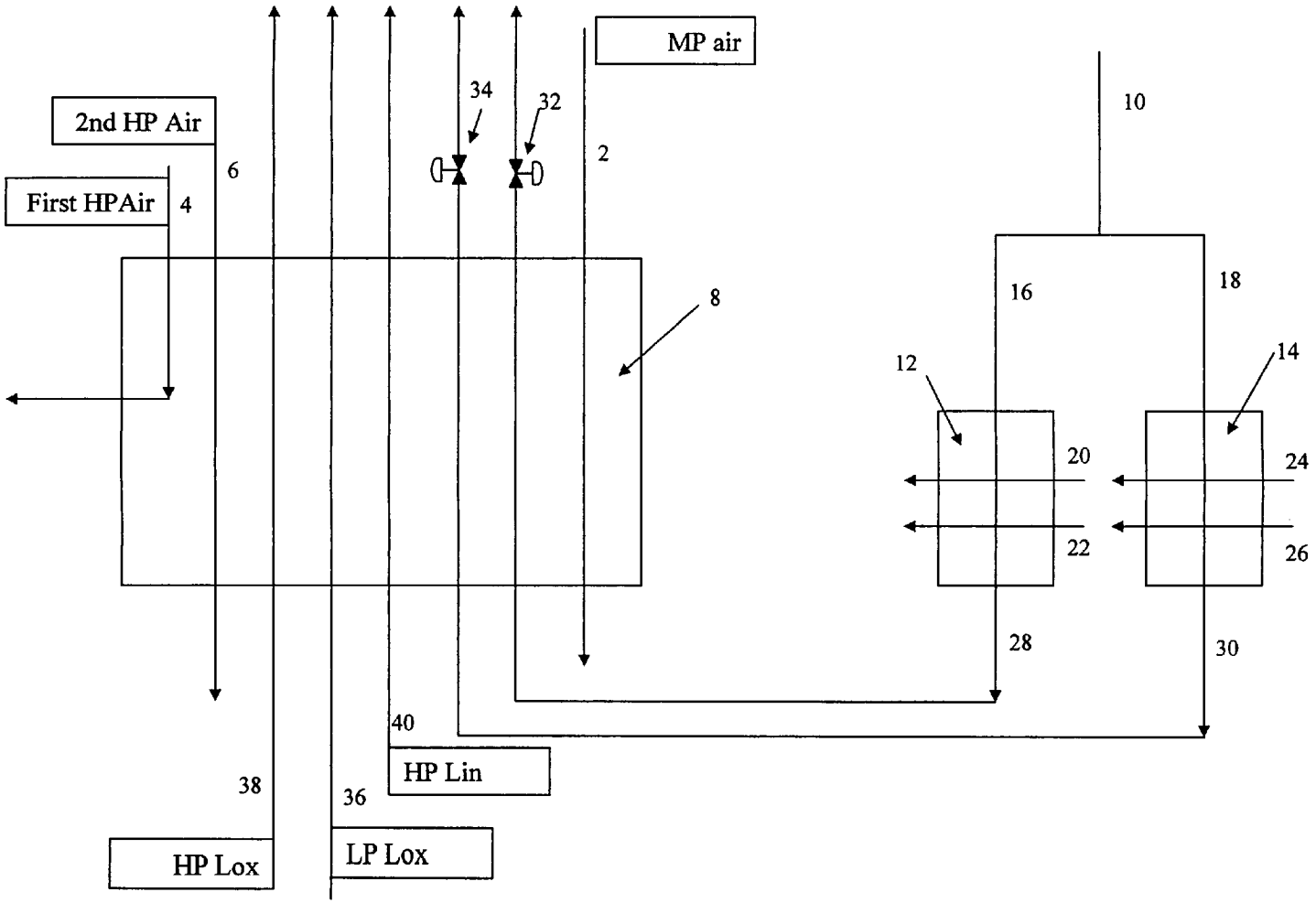

Battery arrangement for BAHX of an ASU – Figure 2
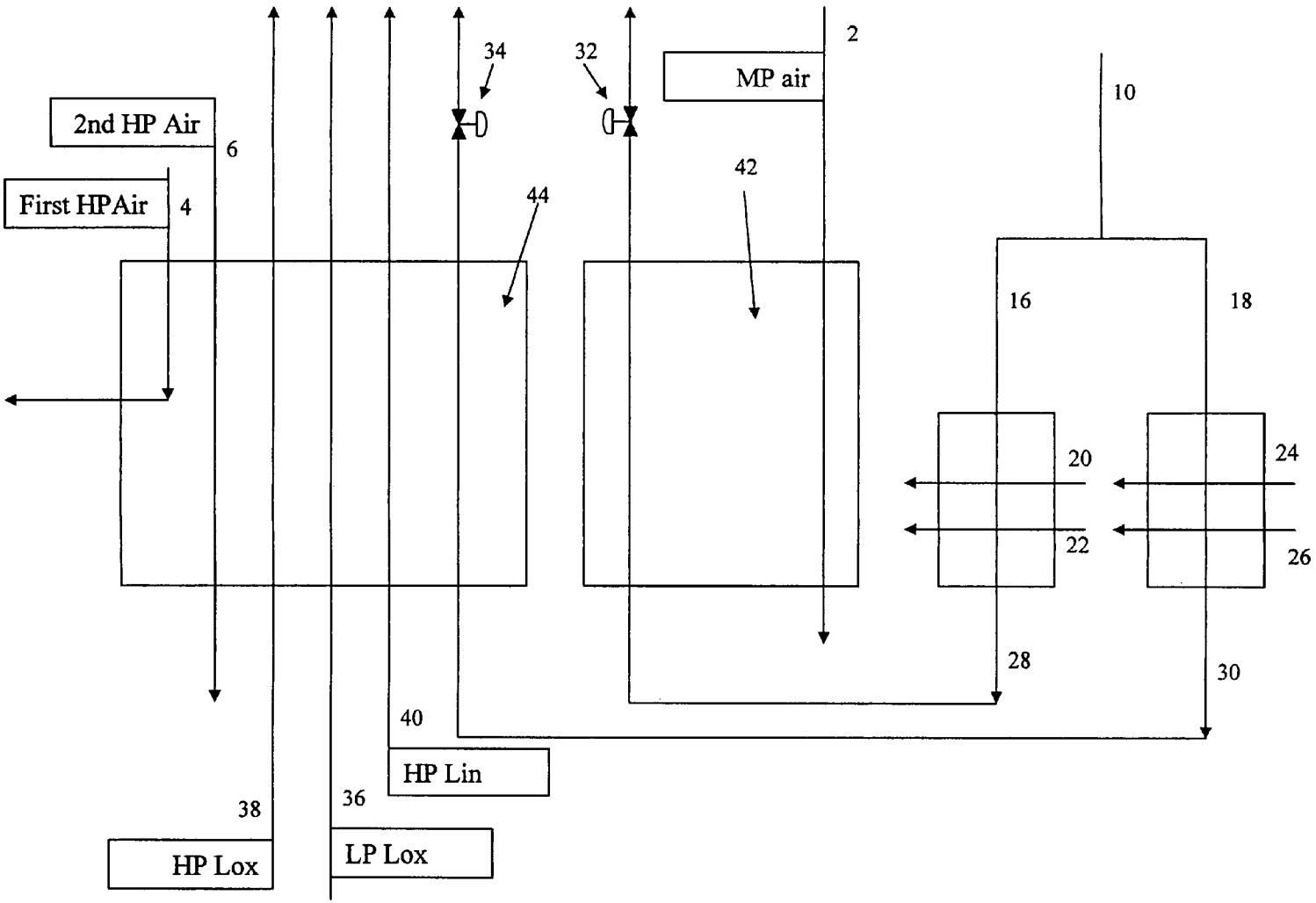

Battery arrangement for BAHX of an ASU – Figure 3
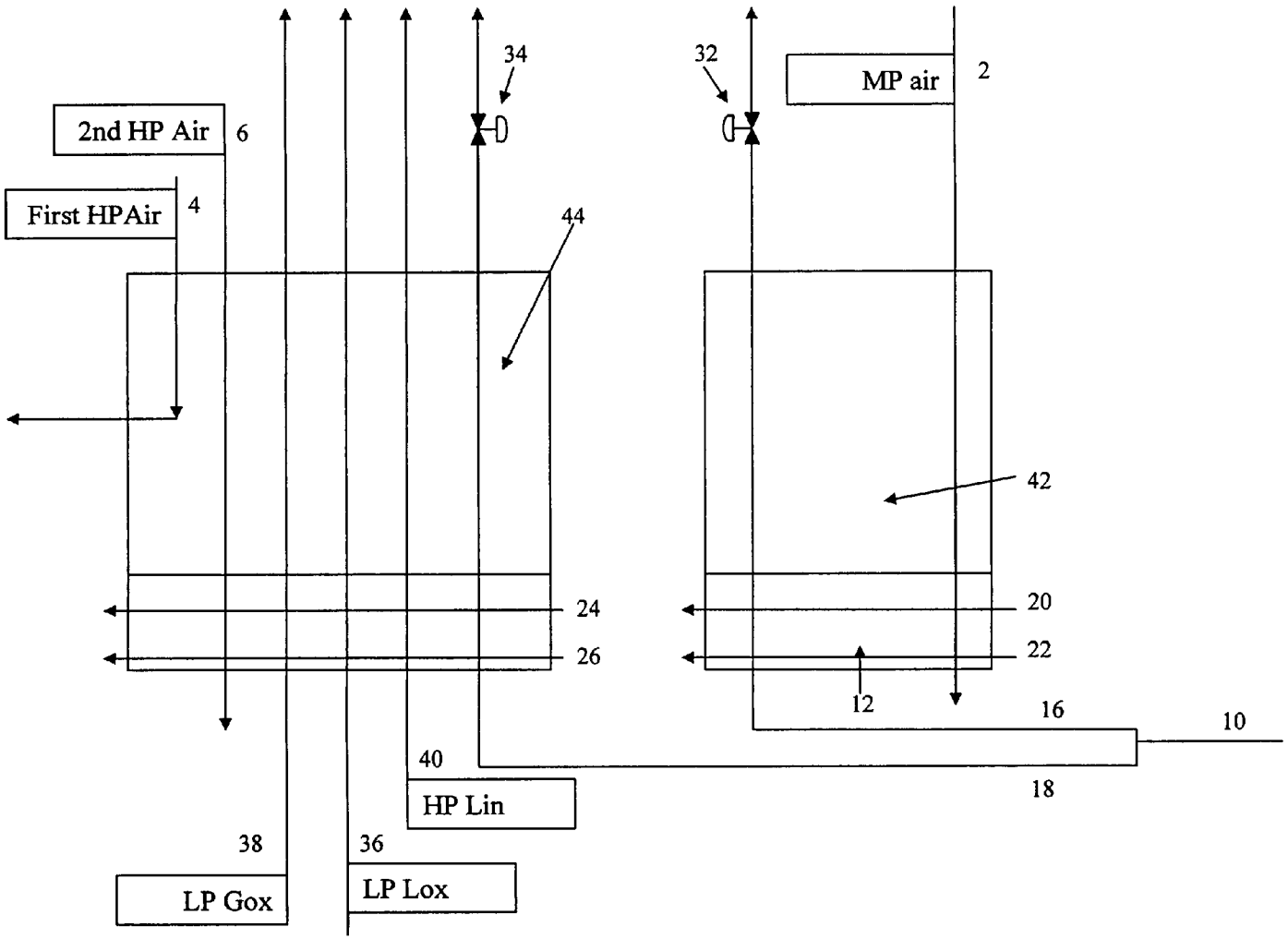

PROCESS AND APPARATUS FOR THE SEPARATION OF AIR BY CRYOGENIC DISTILLATION

BACKGROUND

This invention applies to the separation of air by cryogenic distillation. Over the years, significant efforts have been devoted to improving the production process and lowering the cost of operation and equipment. One way to reduce costs of air separation units is to reduce the size and complexity of the equipment and piping systems.

Air is frequently separated by cryogenic distillation in a double column comprising the steps of feeding compressed, cooled, and purified air to a high pressure column where it is separated into a first nitrogen enriched stream at the top of the column and a first oxygen enriched stream at the bottom of the column. At least a portion of the first oxygen enriched stream is fed to a low pressure column to yield a second nitrogen enriched stream at the top and a second oxygen enriched stream at the bottom. A second oxygen enriched stream is separated at the bottom and a second nitrogen enriched stream is separated at the top of the low pressure column.

Air is sometimes separated by cryogenic distillation in a triple column comprising the steps of feeding compressed, cooled, and purified air to a high pressure column where it is separated into a first nitrogen enriched stream at the top of the column and a first oxygen enriched stream at the bottom of the column. At least a portion of the first oxygen enriched stream is fed to an intermediate pressure column to yield a second nitrogen enriched stream at the top and a second oxygen enriched stream at the bottom. At least a portion of the second nitrogen enriched stream is sent to a low pressure column or top condenser of an argon column, and at least a portion of the second oxygen enriched stream is sent to the low pressure column. A third oxygen enriched stream is separated at the bottom and a third nitrogen enriched stream is separated at the top of the low pressure column. Typically, the distillation columns are stacked on top of each other.

The nitrogen coming off the low pressure column (or the low pressure and intermediate pressure columns in the case of a triple column), which is very cold, is then removed from the separation system as product or waste gas. To assist in the separation and save on energy costs, the cold nitrogen streams are passed through a subcooler where distillation column liquids are cooled while heating the nitrogen before it is sent to the main heat exchanger. In the main heat exchanger, incoming air is cooled by the outgoing product and waste streams before being introduced into the cryogenic separation system. It is known to one of ordinary skill in the art that the main heat exchanger may be divided into two units wherein one unit contains the higher pressure gases and another contains the lower pressure gases.

U.S. Pat. Nos. 6,202,441, 6,276,170, 6,314,757 and 6,347,534, which are not admitted to be prior art with respect to the present invention, further describe the cryogenic separation processes known in the art and disclose information relevant to the cryogenic separation of air. However, these references suffer from one or more of the disadvantages discussed below.

The production capacities of modern air separation units continue to rise, thus units are becoming physically larger. Larger equipment and piping leads to layout, equipment, and piping design problems. For instance, a modern 5,000 ton per day unit may have a 72 inch line coming from the top of the low pressure column feeding the subcooler. As the nitrogen warms in the subcooler, it expands requiring an even larger line, 94 inch, exiting the subcooler. These large lines lead to very large cryogenic enclosures, and present significant thermal stress issues to designers. Furthermore, modern subcoolers are typically brazed fin exchangers of a highly compact design. Thus, the designer is faced with significant problems routing the large lines into and out of a single small, compact exchanger. Furthermore, the builder of the exchanger must mount larger headers on the brazed fin exchanger to facilitate receiving and discharging the nitrogen stream. These design issues lead problems with thermal stresses in the larger equipment pieces, higher equipment costs, and larger plant footprints.

Accordingly, it is a goal of the invention to provide a process design and apparatus configuration that allows the nitrogen leaving the cryogenic separation column to be separated into multiple streams feeding multiple subcoolers. By providing multiple subcoolers which cool different separation streams, the nitrogen flow is split and the line sizes are dramatically decreased. Correspondingly, the design problems and increased costs associated with the large piping and headers in the area of the subcooler are alleviated.

It is a further goal of the invention to simplify the piping and reduce equipment costs by integrating the subcoolers with corresponding main heat exchangers. By integrating the two, the piping between the subcooler and main heat exchangers may be eliminated.

SUMMARY

The present invention is directed to a process and apparatus for separating air by cryogenic distillation that satisfies the need to reduce the sizes of piping and equipment associated with an air separation unit. According to the invention, the nitrogen stream exiting a system of separation columns is divided into two or more streams with each stream routed to a discrete subcooler.

According to the invention, there is provided process for separating air by cryogenic distillation using at least two discrete subcoolers comprising the steps of:

a) compressing an air stream;
b) cooling said air stream in a main heat exchanger;
c) feeding said air stream to a system of separation columns;
d) separating at least one nitrogen stream from said air stream in said system of separation columns;
e) removing a first subcooler nitrogen stream and a second subcooler nitrogen stream from the system of separation columns;
f) passing said first subcooler nitrogen stream through a first subcooler;
g) passing said second subcooler nitrogen stream through a second subcooler;
h) sending said first subcooler nitrogen stream to said main heat exchanger after said first subcooler nitrogen stream passes through said first subcooler;
i) sending said second subcooler nitrogen stream to said main heat exchanger after said second nitrogen subcooler stream passes through said second subcooler;
j) cooling at least a first process stream in said first subcooler; and
k) cooling at least a second process stream in said second subcooler.

One should note that the air stream referenced above can, and preferably is, divided into multiple streams of a variety of pressures. These streams are cooled and fed to the system of separation columns as required for the operation of that system. Furthermore, the system of separation columns referenced above can be those of any of a variety of processes for separating air into its components.

According to alternate embodiments of the invention:

said main heat exchanger comprises a low-pressure main heat exchanger and a high-pressure main heat exchanger;

said first subcooler nitrogen stream feeds said low-pressure main heat exchanger after said first subcooler nitrogen stream passes through said low-pressure subcooler;

said first subcooler is integrated with said low-pressure main heat exchanger;

said second subcooler nitrogen stream feeds said high-pressure main heat exchanger after said second nitrogen subcooler stream passes through said high-pressure subcooler;

said second subcooler is integrated with said high-pressure main heat exchanger;

said nitrogen stream comes from a low pressure separation column of a double or triple air separation column or an intermediate pressure column of a triple column;

the flow rates of said first subcooler nitrogen stream and said second subcooler nitrogen stream are controlled by a control system;

said control system comprises a first control valve and a second control valve;

said first process stream is selected from the group of streams consisting of a rich liquid stream, a liquid air stream, a lean liquid stream, a liquid oxygen stream, and combinations thereof;

said second process stream is selected from the group of streams consisting of a rich liquid stream, a liquid air stream, a lean liquid stream, a liquid oxygen stream, and combinations thereof;

a process stream is divided in two to form the first and second process streams;

removing a nitrogen stream from the system of separation columns and dividing the nitrogen stream to form first and second subcooler nitrogen streams.

According to a further aspect of the invention, there is provided an apparatus for separating air by cryogenic distillation using at least two discrete subcoolers comprising:

a) a system of separation columns, b) a first subcooler, c) a second subcooler, d) a main heat exchanger, e) a conduit for sending nitrogen from said system of separation columns to said first subcooler, f) a conduit for sending nitrogen from said system of separation columns to said second subcooler, g) a conduit for sending nitrogen from said first subcooler to said main heat exchanger, h) a conduit for sending nitrogen from said second subcooler to said main heat exchanger, i) a conduit for sending a first warm stream to said first subcooler, wherein said first warm stream is cooled in said first subcooler, j) a conduit for sending a second warm stream to said second subcooler, wherein said second warm stream is cooled in said high-pressure subcooler, k) a conduit for sending a first cooled stream from said low-pressure subcooler to said system of separation columns, and l) a conduit for sending a second cooled stream from said high-pressure subcooler to said system of separation columns.

According to further options:

there is a control system, wherein said control system controls the nitrogen stream flow rates to said first subcooler and said second subcooler;

said main heat exchanger comprises a low-pressure main heat exchanger and a high-pressure main heat exchanger;

said conduit for sending nitrogen from said first subcooler to said main heat exchanger sends nitrogen from said first subcooler to said low-pressure main heat exchanger;

said conduit for sending nitrogen from said second subcooler to said main heat exchanger sends nitrogen from said second subcooler to said high-pressure main heat exchanger;

said first subcooler is integrated with said low-pressure main heat exchanger;

said second subcooler is integrated with said high-pressure main heat exchanger.

there are means for dividing a nitrogen stream from a column of the column system to form first and second subcooler streams.

The current invention has the advantage of reducing the piping size and thus addressing the design and construction problems associated the subcoolers, piping, and associated equipment. The improved design lowers the fabrication costs of the subcoolers and the plant construction costs. The system has the further advantage of improved safety and reliability by reducing the thermal stresses and thus the failure rate of the equipment.

Alternately, the main heat exchanger may be divided into multiple discrete units, to reduce the complexity, reduce costs, and improve layout of separation systems.

As a further improvement, the subcoolers of the current invention may be integrated with the discrete main heat exchangers to further reduce piping complexity and equipment costs.

BRIEF DESCRIPTION OF THE DRAWINGS

FIG. 1 is a schematic representation of one preferred embodiment of the cryogenic process of this invention.

FIG. 2 is a schematic representation of a second preferred embodiment of the cryogenic process of this invention.

FIG. 3 is a schematic representation of a third preferred embodiment of the cryogenic process of this invention.

The present invention is directed to a process and apparatus for separating air by cryogenic distillation that satisfies the need to reduce the sizes of piping and equipment associated with an air separation unit. The invention divides the nitrogen stream exiting a system of separation columns into two or more streams, with each stream routed to a discrete subcooler.

As used herein, "system of separation columns" means a combination of columns required to effect the separation of air into its components. A typical air separation process, will have three column sections integrated into one system. The bottom column is the high pressure column, the middle column is the medium pressure column and the top column is the low pressure column. The combination of columns and the associated equipment is the system of separation columns. The system of separation columns typically separate nitrogen and oxygen from air, but may include systems that separate argon, xenon, krypton, or other components of air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing.

As used herein the "subcooler" means the apparatus for cooling a liquid of the process that uses nitrogen exiting the system of separation columns to cool process streams before that nitrogen passes to the main heat exchanger. "Subcooling" typically refers to cooling a stream to a temperature lower than that liquid's saturation temperature for the existing pressure. However, in the invention, a subcooler may be used to simply cool a process stream. A subcooler typically passes a cold nitrogen stream exiting the cryogenic columns in a countercurrent fashion with warmer column streams in order to subcool the column streams and warm the exiting nitrogen stream before passing it to the main heat exchanger.

As used herein, the term "main heat exchanger" means the heat exchanger or heat exchangers that cool the incoming streams by counterflowing the cold exiting streams with the warm incoming streams. The main heat exchanger may be divided into two or more discrete main heat exchangers, referred to as a high pressure main heat exchanger (HPMHE) and a low pressure main heat exchanger (LPMHE). The HPMHE receives all the streams at a pressure above a given pressure and the LPMHE receives streams at a pressure below the given pressure. In this way, the LPMHE may of less robust construction than the HPMHE. The HPMHE receives high pressure incoming air, which enters at above 40 bars pressure in one embodiment. The LPMHE receives the medium pressure, incoming air, which enters at about 6 bars pressure in one embodiment.

As used herein, "low pressure nitrogen" means nitrogen coming from the top of the low pressure separation column. In one embodiment, the low pressure nitrogen exits the low pressure column at about 1 to 2 bars pressure.

As used herein, "medium pressure nitrogen" means nitrogen coming from the top of the medium pressure separation column.

As used herein, "rich liquid" means the liquid stream coming from the bottom of the high pressure separation column that is oxygen rich. In one embodiment, this stream operates at about 6 bar pressure.

As used herein, "lean liquid" means the liquid stream coming from the upper section of the high pressure separation column that is oxygen lean. In one embodiment, this stream operates at about 6 bar pressure.

As used herein, "liquid air" means liquefied air, for example the liquid stream that exits the side of the high pressure column, typically in the middle section. In one embodiment, this stream operates at about 6 bar pressure.

As used herein, "liquid oxygen stream" (Lox) means the liquid stream coming from the bottom of the medium pressure column. In one embodiment, this stream operates at about 2 bar pressure.

As used herein, "medium pressure air" (MP Air) means the incoming air stream coming from the primary air compression system without further compression. This stream is fed as a gas into the bottom of the high pressure separation column after cooling. In one embodiment, medium pressure air enters the high pressure column at about 6 bars.

As used herein, "warmed nitrogen stream" means the low pressure nitrogen stream exiting the main heat exchanger or exchangers. This may be referred to as waste nitrogen or may be product. In one embodiment, the warmed nitrogen stream exits the main heat exchanger at about 1 to 2 bars pressure. If the main heat exchanger is divided into two discrete devices, the nitrogen streams exiting the low pressure main heat exchanger are referred to herein as the first warmed nitrogen stream, and the nitrogen exiting the high pressure main heat exchanger is referred to herein as the second warmed nitrogen stream.

As used herein, "low pressure oxygen stream" (LPox) means the oxygen stream exiting the system of separation columns. In one embodiment, this stream is pumped up to a pressure of about 12 bars before being sent to the main heat exchanger.

As used herein, "high pressure oxygen stream" (HPox) means the oxygen stream exiting the system of separation columns after it is pumped up to high pressure. In one embodiment, this stream is pumped up to a pressure of about 73 bars before being sent to the main heat exchanger.

As used herein, "high pressure liquid nitrogen stream" (HP Lin) means the nitrogen stream exiting the system of separation columns before it is warmed in the main heat exchanger after it has the pressure raised. In one embodiment, this stream is pumped up to a pressure of about 11.5 bars.

As used herein, "first high pressure air stream" (First HP Air) means the air stream entering the main heat exchanger that has passed through the primary compression system and a booster compressor. In one embodiment, the pressure is raised to about 50 bars.

As used herein, "cooled first high pressure air stream" means the First HP Air stream after it is cooled in the main heat exchanger. This stream typically feeds the side of the medium pressure column after being expanded in an expansion valve or expansion turbine.

As used herein, "second high pressure air stream" (Second HP Air) means the air stream entering the main heat exchanger which has passed through the primary compression system and a booster compressor. In one embodiment, the pressure is raised to about 69 bars.

As used herein, "cooled second high pressure air stream" means the Second HP Air stream after it is cooled in the main heat exchanger. This stream typically feeds the side of the high pressure column after being expanded in an expansion valve or expansion turbine.

As used herein, "low pressure liquid oxygen stream" (LP Lox) means the oxygen stream exiting the system of separation columns before it has been vaporized in the main heat exchanger that operates at pressures less than the high pressure liquid oxygen stream. In one embodiment, the LP Lox operates at about 12 bars pressure.

As used herein, "high pressure liquid oxygen stream" (HP Lox) means the oxygen stream exiting the system of separation columns before it has been vaporized in the main heat exchanger that is pumped up to a high operating pressure. In one embodiment, the HP Lox operates at about 73 bars pressure.

As used herein, "cooled medium pressure air stream" (CMP air) means the MP Air stream coming from the primary inlet compression system after cooling. This stream is fed into the bottom of the high pressure separation column.

Referring to FIG. 1, one embodiment of the current invention separates air into components by compressing it into a medium pressure air stream (MP Air) 2, a first high pressure air stream (First HP Air) 4, and a second high pressure air stream (Second HP Air) 6. These streams are cooled in a main heat exchanger 8, and then fed to a system of separation columns ASU. The system of separation columns separates a low pressure nitrogen stream 10 from the air streams for removal from the system. The process utilizes at least a first subcooler 12 and a second subcooler 14 to cool incoming feed streams or streams from the system of separation columns while warming the low pressure nitrogen as it passes to the main heat exchanger 8. The first subcooler 12 and second subcooler 14 are discrete units. One of ordinary skill in the art of designing and fabricating cryogenic subcoolers can fabricate the discrete subcoolers required for the present invention.

Referring again to FIG. 1, the low pressure nitrogen stream 10 is divided into a first subcooler nitrogen stream 16 and a second subcooler nitrogen stream 18. The low pressure nitrogen stream 10 is the vent from any column in the system of separation columns ASU. The low pressure nitrogen stream 10 may be the vent from the low pressure column (not shown) of the system of separation columns, the vent from the intermediate pressure column, the vent from the medium pressure column, a combination of those streams, or any other cold vent stream exiting the system of separation columns. In one embodiment, the vent from the low pressure column is routed to one subcooler while the vent from the medium pressure column is routed to another subcooler.

Again referring to FIG. 1, the first subcooler nitrogen stream 16 is warmed in the first subcooler 12 while cooling streams from the system of separation columns. The first subcooler 12 preferably cools a rich liquid stream 20, an air liquid stream 22, or both. However, the first subcooler 12 can also cool any process stream of the air separation unit, including a lean liquid stream, a liquid oxygen stream, and combinations thereof. Similarly, the second subcooler nitrogen stream 18 is warmed in the second subcooler 14 while subcooling streams from the system of separation columns. The 14 preferably cools a lean liquid stream 24, a liquid oxygen stream 26, or both. The second subcooler 14 can also cool any process stream of the air separation unit, including a rich liquid stream 20, an air liquid stream 22, and combinations thereof.

Still referring to FIG. 1, the nitrogen streams exiting the first subcooler 12 and the second subcooler 14 are sent to the main heat exchanger 8 to provide cooling to the medium pressure air stream (MP Air) 2, first HP air stream (HP air 1) 4, and second high pressure air stream (Second HP Air) 6. The nitrogen streams exiting the first subcooler 12 and the second subcooler 14 are preferably routed to the main heat exchanger 8 in separate lines, but may be combined into one line supplying the main heat exchanger 8.

The first subcooler nitrogen stream 16 flow rate and the second subcooler nitrogen stream 18 flow rate are controlled by a first control valve 32 and a second control valve 34, preferably, but not necessarily, located in their respective flow conduits. These control valves are preferably, but not necessarily, located on the outlet of the main heat exchanger 8. The flow rates of the respective streams are preferably controlled by a control scheme that divides the low pressure nitrogen stream 10 on a ratio basis between the first subcooler 12 and the second subcooler 14.

One of ordinary skill in the art will recognize that the system of separation columns will typically produce streams of low pressure liquid oxygen (LPLox) 36, high pressure liquid oxygen (HP Lox) 38 and high pressure liquid nitrogen (HP Lin) 40. These streams are also routed through the main heat exchanger 8 to provide cooling to the incoming air streams.

One of ordinary skill in the art will also recognize that there are various configurations known in the art to compress the air, including the use of multiple compression systems. The First HP Air 4 and Second HP Air 6 streams typically enter the main heat exchanger at above 40 bars pressure. The MP Air 2 typically enters the main heat exchanger at about 6 bars pressure, but can be about 4 to about 10 bars. Furthermore, one will recognize that there may be more or fewer discrete air streams than the three streams shown in the embodiments of this invention.

In addition, one skilled in the art will recognize that there are various configurations for the system of separation columns that may be used with the current invention for separating the components of air. The embodiments of this application refer to a typical system of separation columns comprising a high pressure separation column, a medium pressure separation column and a low pressure separation column. However, the current invention may be used with any system of separation columns that separates the components of air.

The embodiment of FIG. 2 utilizes the same process as described above. However, in this embodiment, the main heat exchanger is separated into a low pressure main heat exchanger (LPMHE) 42 and high pressure main heat exchanger (HPMHE) 44, which are discrete exchangers. The low pressure nitrogen exiting the first subcooler 12 is preferably, but not necessarily, routed to the LPMHE 42. Similarly, the low pressure nitrogen exiting the second subcooler 14 is preferably, but not necessarily, routed to the HPMHE 44. It is known by one of ordinary skill in the art how to design and fabricate a LPMHE and a HPMHE.

The embodiment of FIG. 3 also uses the same process of FIG.1 as described above. Also, like the process of FIG.2, the main heat exchanger is separated into a low pressure main heat exchanger (LPMHE) 42 and high pressure main heat exchanger (HPMHE) 44, which are discrete exchangers. However, in the embodiment of FIG. 3, the first subcooler 12 is integrated into the LPMHE 42 and the second subcooler 14 is integrated into the high pressure main heat exchanger 44. One of ordinary skill in the art of cryogenic heat exchanger fabrication can design and fabricate the integrated exchangers of the current invention.

Although the present invention has been described in considerable detail with reference to certain preferred versions thereof, other versions are possible. For example, a system of separation columns may comprise two columns, or may include an argon separation section. Likewise, the main heat exchanger may comprise one, two, or more discrete exchangers. Furthermore, the invention is applicable to two, three, or more subcoolers in the separation process, with process streams divided among the discrete subcoolers. Still further, there may be alternate configurations of subcoolers and main heat exchangers such as a second subcooler integrated with a HPMHE while the first subcooler and LPMHE are discrete units or a first subcooler integrated with a LPMHE while the second subcooler and HPMHE are discrete units. There are also a variety of control schemes known in the art to control the flow or pressure of the nitrogen passing through the subcoolers of the current invention such as self contained regulators, pressure control valves, flow orifices, flow control valves, or other flow regulating devices. Therefore, the spirit and scope of the appended claims should not be limited to the description of the preferred versions contained herein.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A process for separating air by cryogenic distillation using at least two subcoolers that are discrete from one another, comprising the steps of:

a) compressing an air stream;

b) cooling said air stream in a main heat exchanger, wherein said main heat exchanger comprises a low-pressure main heat exchanger and a high-pressure main heat exchanger;

c) feeding said air stream to a system of separation columns;

d) separating at least one nitrogen stream from said air stream in said system of separation columns;

e) removing a first subcooler nitrogen stream and a second subcooler nitrogen stream from the system of separation columns;

f) passing said first subcooler nitrogen stream through a first subcooler, wherein said first subcooler is a low-pressure subcooler, and wherein said first subcooler nitrogen stream feeds said low-pressure main heat exchanger after said first subcooler nitrogen stream passes through said low-pressure subcooler;

g) passing said second subcooler nitrogen stream through a second subcooler;

h) sending said first subcooler nitrogen stream to said main heat exchanger after said first subcooler nitrogen stream passes through said first subcooler;

i) sending said second subcooler nitrogen stream to said main heat exchanger after said second nitrogen subcooler stream passes through said second subcooler;

j) cooling at least a first process stream in said first subcooler; and k) cooling at least a second process stream in said second subcooler.

2. A process for separating air by cryogenic distillation using at least two subcoolers that are discrete from one another, comprising the steps of:

a) compressing an air stream;

b) cooling said air stream in a main heat exchanger, wherein said main heat exchanger comprises a low-pressure main heat exchanger and a high-pressure main heat exchanger;

c) feeding said air stream to a system of separation columns;

d) separating at least one nitrogen stream from said air stream in said system of separation columns;

e) removing a first subcooler nitrogen stream and a second subcooler nitrogen stream from the system of separation columns;

f) passing said first subcooler nitrogen stream through a first subcooler;

g) passing said second subcooler nitrogen stream through a second subcooler, wherein said second subcooler is a high-pressure subcooler, and wherein said second subcooler nitrogen stream feeds said high-pressure main heat exchanger after said second nitrogen subcooler stream passes through said high-pressure subcooler;

h) sending said first subcooler nitrogen stream to said main heat exchanger after said first subcooler nitrogen stream passes through said first subcooler;

i) sending said second subcooler nitrogen stream to said main heat exchanger after said second nitrogen subcooler stream passes through said second subcooler;

j) cooling at least a first process stream in said first subcooler; and k) cooling at least a second process stream in said second subcooler.

3. A process for separating air by cryogenic distillation using at least two subcoolers that are discrete from one another, comprising the steps of:

a) compressing an air stream;

b) cooling said air stream in a main heat exchanger;

c) feeding said air stream to a system of separation columns;

d) separating at least one nitrogen stream from said air stream in said system of separation columns;

e) removing a first subcooler nitrogen stream and a second subcooler nitrogen stream from the system of separation columns, wherein the flow rates of said first subcooler nitrogen stream and said second subcooler nitrogen stream are controlled by a control system, wherein said control system comprises a first control valve and a second control valve;

f) passing said first subcooler nitrogen stream through a first subcooler;

g) passing said second subcooler nitrogen stream through a second subcooler;

h) sending said first subcooler nitrogen stream to said main heat exchanger after said first subcooler nitrogen stream passes through said first subcooler;

i) sending said second subcooler nitrogen stream to said main heat exchanger after said second nitrogen subcooler stream passes through said second subcooler;

j) cooling at least a first process stream in said first subcooler: and cooling at least a second process stream in said second subcooler.

4. An apparatus for separating air by cryogenic distillation using at least two discrete subcoolers comprising:

a) a system of separation columns, b) a first subcooler. wherein said first subcooler is a low-pressure subcooler, c) a second subcooler, wherein said second subcooler is a high-pressure subcooler, d) a main heat exchanger, wherein said main heat exchanger comprises a low-pressure main heat exchancier and a high-pressure main heat exchanger;

e) a conduit for sending nitrogen from said system of separation columns to said first subcooler, f) a conduit for sending nitrogen from said system of separation columns to said second subcooler, g) a conduit for sending nitrogen from said first subcooler to said main heat exchanger, wherein said conduit for sending nitrogen from said first subcooler to said main heat exchanger sends nitrogen from said first subcooler to said low-pressure main heat exchanger;

h) a conduit for sending nitrogen from said second subcooler to said main heat exchanger, i) a conduit for sending a first warm stream to said first subcooler, wherein said first warm stream is cooled in said first subcooler, j) a conduit for sending a second warm stream to said second subcooler, wherein said second warm stream is cooled in said high-pressure subcooler, k) a conduit for sending a first cooled stream from said low-pressure subcooler to said system of separation columns, and l) a conduit for sending a second cooled stream from said high-pressure subcooler to said system of separation columns.

5. An apparatus for separating air by cryogenic distillation using at least two discrete subcoolers comprising:

a) a system of separation columns, b) a first subcooler, wherein said first subcooler is a low-pressure subcooler, c) a second subcooler, wherein said second subcooler is a high-pressure subcooler, d) a main heat exchanger, wherein said main heat exchanger comprises a low-pressure main heat exchanger and a high-pressure main heat exchanger;

e) a conduit for sending nitrogen from said system of separation columns to said first subcooler, f) a conduit for sending nitrogen from said system of separation columns to said second subcooler, g) a conduit for sending nitrogen from said first subcooler to said main heat exchanger, h) a conduit for sending nitrogen from said second subcooler to said main heat exchanger, wherein said conduit for sending nitrogen from said second subcooler to said main heat exchanger sends nitrogen from said second subcooler to said high-pressure main heat exchanger i) a conduit for sending a first warm stream to said first subcooler, wherein said first warm stream is cooled in said first subcooler, j) a conduit for sending a second warm stream to said second subcooler, wherein said second warm stream is cooled in said high-pressure subcooler, k) a conduit for sending a first cooled stream from said low-pressure subcooler to said system of separation columns, and l) a conduit for sending a second cooled stream from said high-pressure subcooler to said system of separation columns.

* * * * *

UNITED STATES PATENT AND TRADEMARK OFFICE

CERTIFICATE OF CORRECTION

PATENT NO. : 7,546,748 B2
APPLICATION NO. : 11/347160
DATED : June 16, 2009
INVENTOR(S) : Frederic Judas It is certified that error appears in the above-identified patent and that said Letters Patent is hereby corrected as shown below:

In Column 10, line 31, replace "subcooler." with --subcooler,--.

In Column 10, line 37, replace the word "exchancier" with the word --exchanger--.

Signed and Sealed this

Thirtieth Day of March, 2010

David J. Kappos

David J. Kappos
*Director of the United States Patent and Trademark Office*